US005515547A

United States Patent [19]

Middleton

[11] Patent Number: 5,515,547

[45] Date of Patent: May 14, 1996

[54] MITTEN-GLOVE COMBINATION FOR THE HANDS

[76] Inventor: David J. Middleton, 20 Quarry Crossing, Hudson Falls, N.Y. 12839

[21] Appl. No.: 443,717

[22] Filed: May 18, 1995

[51] Int. Cl.[6] ..... A41D 13/10

[52] U.S. Cl. ..... 2/158; 2/159; 2/161.6; 2/163

[58] Field of Search ..... 2/158, 159, 160, 2/161.5, 161.6, 163, 169

[56] References Cited

U.S. PATENT DOCUMENTS

| | | | |
|---|---|---|---|
| 742,440 | 10/1903 | Johnson | 2/158 X |
| 1,329,073 | 1/1920 | Czicziriga | 2/159 X |
| 1,669,010 | 5/1928 | Natho | 2/159 X |
| 2,937,377 | 5/1960 | Mackay et al. | 2/158 |
| 2,937,379 | 5/1960 | Mackay et al. | 2/158 |
| 4,933,992 | 6/1990 | Kallman | 2/158 X |

FOREIGN PATENT DOCUMENTS

| | | | |
|---|---|---|---|
| 669607 | 12/1938 | Germany | 2/158 |
| 214155 | 7/1967 | Sweden | 2/158 |

*Primary Examiner*—C. D. Crowder
*Assistant Examiner*—Shirra L. Jenkins

[57] ABSTRACT

A mitten-glove combination for the hands. The palm portion is a full functioning glove, while the back portion serves as a full featured mitten. Web portions are located between the fingers in order to separate the fingers and allow for lateral movement. A method for using the mitten-glove combination includes inserting the hand into the glove portion, removing the hand from the glove portion when it gets cold and inserting the hand into the mitten portion. In addition, the mitten portion is provided with a mating hook and loop fasteners for securing the mitten back upon itself when not in use.

6 Claims, 3 Drawing Sheets

MITTEN-GLOVE COMBINATION FOR THE HANDS

TECHNICAL FIELD

The present invention relates generally to fitted coverings for the hand, and more specifically to mitten-glove combinations.

BACKGROUND OF THE INVENTION

1. Field of the Invention

This invention relates to fitted hand coverings such as gloves and mittens, and more particularly to a modified glove and mitten combination to enable the wearer to have the dexterity of gloves and the warmth of mittens.

2. Description of the Prior Art

Gloves currently on the market are composed of a wide variety of styles and uses and are collectively composed of a fitted covering for the hand having a separate section for each finger. In use the wearer pushes their hand through the cuff, or opening and proceeds to insert a finger into each of the separate finger sections. At this point each finger is totally isolated from any source of heat except the heat produced by that individual finger. On very cold days the wearer may find their fingers getting cold. A common reaction is to pull the fingers out of the finger sections and curl them into a ball in the palm section of the glove to try to warm the fingers. At this point the finger sections are completely isolated from any appreciable heat and start cooling to the ambient temperature. When the wearer reinserts their fingers into the finger sections they find their fingers getting cold again, very rapidly.

Mittens are the alternative that comprises a covering for the hand that has one portion for the thumb and another for all four fingers. Wearing mittens is an excellent means of keeping the wearers' hands and fingers warm by collectively releasing and absorbing circulated heat from the hand and finger surfaces. For the warmth a mitten provides, flexibility and dexterity are lost.

Mitten-Glove combinations have previously been provided. For example, modified mitten-glove combinations of one type or another are disclosed in U.S. Pat. No. 2,603,790, Boehm-Myro, July, 1952; U.S. Pat. No. 2,323,136, Johanson, Jun. 29, 1943; and U.S. Pat. No. 4,195,405, Monk, Apr. 1, 1980. The aforementioned patents share common and individual deficiencies such as multiple palm portions and multiple backing portions adding to the overall bulk and weight, and are cumbersome to the wearers' hands. Another disadvantage is the retractable mitten portions are not out of the way. Another disadvantage is prior art mitten-glove combinations require using the opposite hand to assist in the changing from a gloved to a mittened hand and conversely, which ties up both hands until the changeover is complete. Another disadvantage of prior art mitten-glove combinations is when the mitten section becomes wet and is rolled\folded up or otherwise disengaged from the heat of the gloved hand, the mitten portion can freeze up making the next use very difficult or impossible until the mitten portion unfreezes. Yet another disadvantage of prior art mitten-glove combinations is that if the glove portion is soiled, the mitten portion becomes soiled when pulled or attached over the glove portion.

SUMMARY OF THE INVENTION

The improved construction that forms the basis for this invention comprises in general a fitted hand protection covering with a typical looking glove on one side and an operatively connected typical looking mitten backing on the other side. The glove portion functions as a typical glove would by having a separate section for each finger, allowing the independent movement of each finger. The open mitten style backing keeps the hand and fingers as warm as if the wearer was wearing typical prior art mittens.

In addition the improved mitten-glove construction allows for the lateral movement of the fingers, collectively or independently.

Furthermore, the improved construction allows for a perpendicular movement of the fingers, collectively or independently.

Additionally, the improved construction allows a portion of the finger section end to be independent of the mitten backing which allows the wearer to independently use each finger for pushing buttons, or operating the trigger of a gun or operating the triggers on power tool's, etc.

Moreover, the improved mitten-glove construction allows the finger hood section to be secured back, and released with or without the assistance of the wearers opposite hand.

In addition, the improved construction allows the finger hood to be folded back onto itself so the operator has a clear view of the finger section ends.

Moreover, the mitten-glove can be made without the finger hood section and the hand would still be considerably warmer than prior art gloves, do to the open (mittened) finger back portions.

Furthermore, the improved construction allows all four fingers to be independently or collectively inserted into the glove portions finger sections, or the mitten portions finger hood section.

Applicant has studied prior art designs of mittens and gloves in an endeavor to further reduce the discomfort of cold conditions on the hands and fingers. Mitten-glove combinations have been used in prior art, however, no invention in the prior art combines the features embodied within applicant's invention in such a way as to minimize discomfort of cold conditions on the hands and fingers.

The present invention seeks to overcome the problem of cold fingers associated with the use of gloves by providing an open backing (mitten style) on a glove's hand and finger area. The backside of the finger section end is provided with a finger end cover that covers the finger ends from the elements and allows for the independent perpendicular movement of the finger section ends. The mitten backing is attached to the bottom of the finger end cover and across the wide section of the pleated web to the next finger end cover, for each finger. After being attached, the mitten material is extended up to the top of the finger section ends, then folded back down towards the cuff, which forms a hood over the finger end covers, and is attached to the glove portion along the end finger sections, around the thumb and along the periphery to the cuff.

The mitten function is fulfilled when the operator retracts their fingers downwards from under the finger end covers far enough to clear the bottom edge of the finger end covers, then the fingers are raised and extended forwards into the finger hood area, which is one opening for all four fingers.

It is an objective of the present invention to provide an improved hand covering with the dexterity of typical prior art gloves, and the ability to keep the fingers warm as in typical prior art mittens.

An additional objective of this invention is to instantly change from a gloved hand to a mitten hand, without the assistance of the opposite hand.

A further objective of this invention is to provide a pleated web portion which allows the lateral, perpendicular, and the like movement of the individual finger sections.

An additional objective of this invention is to provide finger end covers, to provide both protection and the perpendicular movement of the finger section end.

An additional objective of this invention is to provide a fast, easy and uncumbersome way to switch from a gloved hand to a mittened hand, without taking the glove off of the hand, or having to pull the glove down a ways to move the fingers from the gloved finger end cover section to the mittens finger hood section.

A yet additional objective of this invention is to provide a means so the wearer can collectively or individually insert any finger into a finger section for individual movement of that finger or fingers.

A further objective of this invention is to provide a low cost, easy to manufacture mitten-glove for the hands.

A further objective of this invention is to provide a mitten-glove for the hands that is warmer than traditional gloves due to the opening up of the back and sides of the fingers to the collective heat of the whole hand (mitten style).

A further objective of this invention is to provide finger sections that stay warm, even when the fingers are in the mitten's finger hood section.

A yet further objective of this invention is to provide a mitten-glove combination that has one gloved side and one mitten side which reduces the amount of bulk and weight on the wearers hands.

In this example of the mitten-glove, the wearer inserts their hand into the opening in the cuff and pushes their fingers towards the bottom of the glove portion of the mitten-glove, under the finger end covers. With the wearer's finger tips under the finger end covers, the hand covering device acts like a typical gloved hand. Each finger can be individually moved up and down, perpendicular, laterally, curled and the like. In the event the wearers finger ends get cold, the wearer can instantly retract there finger tips downwards past the finger end covers straight edge, then extends there fingers upwards and forwards into the finger hood of the mitten backing for increased warmth, without having to pull the mitten-glove down, or use the opposite hand to move the finger tips from the glove portions finger section end to the mitten portions finger hood section or the reverse.

In this example, the mitten-glove is being used with the fingers in the finger sections. The wearer may need to do some intricate work, such as pushing on\off buttons on machinery that requires the sight of the finger tips for precise placement. In this case the finger hood is folded or brushed back by the opposite hand or against any stationary object such as the wearers leg, anywhere against the wearers body, against any wall, etc., onto itself and temporarily secured in place with hook and loop material. When the wearer requires the use of the finger hood section, the folded portion is lifted or brushed upwards by the opposite hand or against any stationary object (i.e. leg, arm, wall, etc.) which releases the hook and loop material, which allows the finger hood section to return to an upright position.

As should be noted, the mitten-glove combination keeps the wearers' hands warm, even when the fingers are in the finger sections. Most of the finger is not isolated as in prior art gloves, but open backed as in a mitten, where the combined heat of the hand and fingers is circulated.

BRIEF DESCRIPTION OF THE DRAWINGS

These and other objects, advantages, and novel feature of the invention will become apparent from the detailed description of the best mode for carrying out the preferred embodiment of this invention which follows, particularly when considered in conjunction with the accompanying drawings, wherein.

BEST MODE FOR CARRYING OUT THE INVENTION

Figure 1:
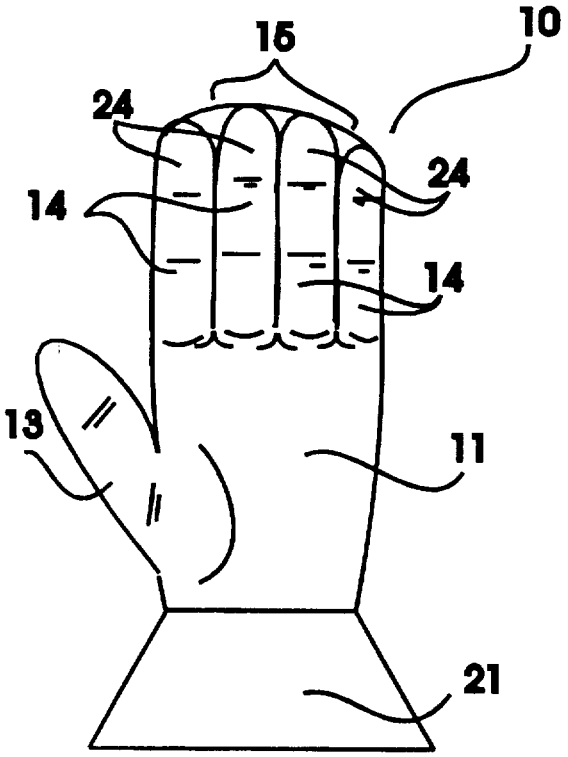
FIG. 1 is a left handed mitten-glove with the glove (palm) side up, finger sections together, and the finger hood.

The mitten-glove invention that comprises the basis of the present invention is designated generally by the reference number (10). The mitten-glove unit (10) comprises in general: Glove features to the palm side (11), with finger sections (14), finger end covers (18), pleated web (19), thumb (13) and a cuff(21). The mitten portion (12) shows a finger hood (15), hook and loop fasteners (16), an elastic band (17), a thumb (13) and a cuff (21). The mitten portion forms the back or backing of the hand covering.

Figure 8A:
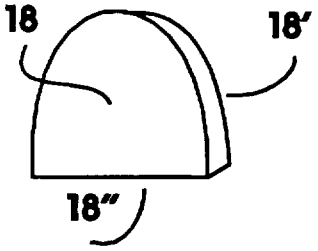
FIG. 8A is a perspective angled view of a finger end cover.
Figure 8B:
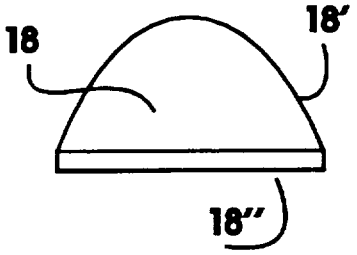
FIG. 8B is a prospective front view of a finger end cover.
Figure 9A:
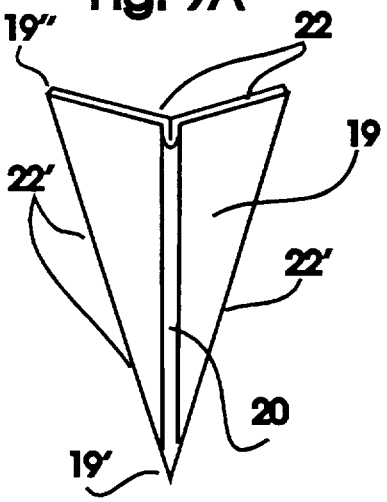
FIG. 9A is a top, front perspective view of a pleated web.
Figure 9B:
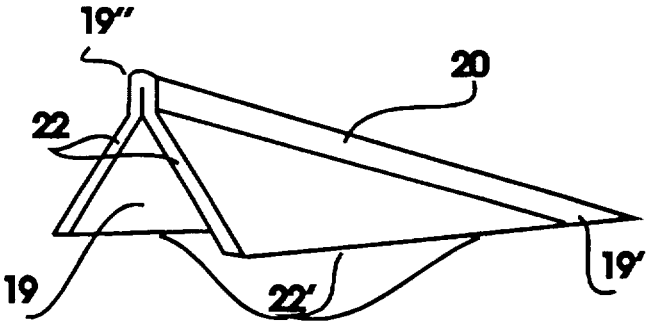
FIG. 9B is a side prospective view of a pleated web.

As can best be seen by reference to the drawings and in particular to FIG. 1. the glove portion (11) is made from a suitable material most generally leather, of the mitten-glove (10) assembly. The wherein, the glove portion (11) has a separate finger section (14) for all four fingers (FIG. 7 No. 14') and a thumb portion (13). The glove portion (11) is accessed by inserting a hand (FIG. 7. No. 23) through the cuff portion (21) between the glove portion (11) and the mitten backing (12), inserting the thumb (FIG. 7 No. 13') into the thumb slot (13), and the fingers (FIG. 7 No. 14') are guided into the individual finger sections (14) by the pleated web (FIG. 9A and 9B No. 19). The finger ends (FIG. 7 No. 14") are in the pocket formed by the finger section (14) end (24) and the finger end covers (FIG. 8A and 8B No. 18).

Figure 2:
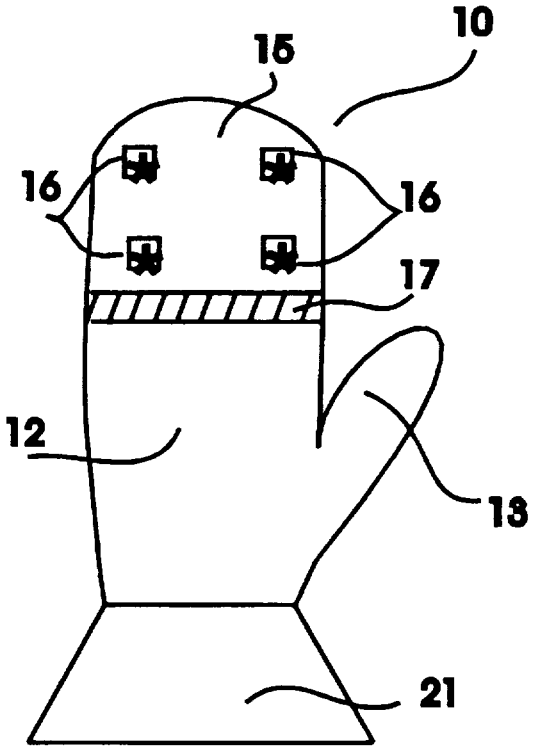
FIG. 2 is a left handed mitten-glove, palm down, with the mitten backing showing the mitten finger hood in the up position, the hook and loop fasteners and a elastic band.
Figure 3:
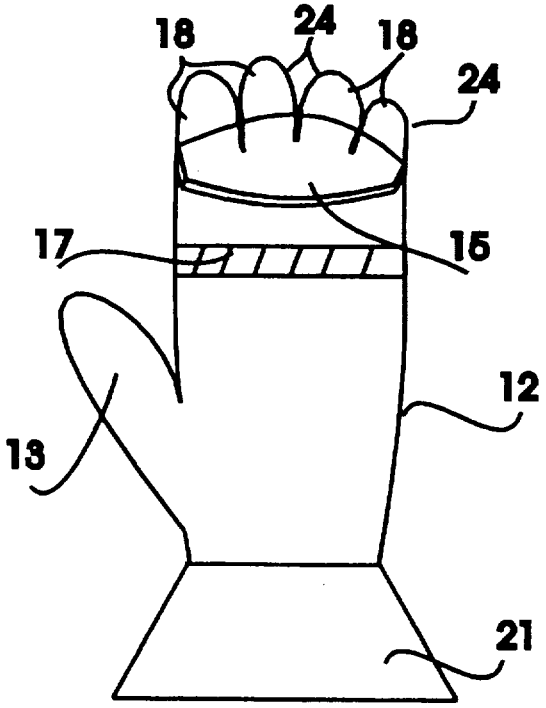
FIG. 3 is a fight handed mitten-glove, palm down, with the finger hood folded back and secured in place, exposing the finger end covers.

As can be seen in FIG. 2 the mitten backing (12) is made of a suitable material such as leather, cotton, nylon or the like. The mitten backing (12) is sewn to the periphery of the glove portion (11). The mitten backing (12) is sewn along the finger end covers (FIG. 3 No. 18) and the pleated webs (FIG. 9A No. 19) across all four finger sections (14). The mitten backing (12) extends upwards to cover the finger end covers (18). The mitten backing material (12) is then folded downwards, over itself towards the cuff (21) forming the finger hood (15). The mitten backing (12) is sewn together along the ends of the finger hood section (15) and is attached to the glove portion ( 11 ) along the outside finger sections (14), the thumb (13 ) and along the periphery to the cuff (21). The joining of the glove portion (11) and the mitten backing (12) form a hollow for the hand (23). The a piece of hook and loop material (16) is sewn to the top of both sides of the finger hood (15). The opposite halves of a hook and loop material (16) are securely fastened a corresponding distance away from the top hook and loop material (16) to allow the finger hood (15) to be secured back away from the finger end covers (FIG. 3 No. 18). The finger hood (15) is folded back and secured in place by the wearers opposite hand (23) brushing the finger hood (15) back until the hook and loop material (16) engage the opposite halves or, the finger hood is secured back by the wearer brushing the top end of the finger hood section (15) against a stationary object to bend the finger hood (15) section back against the hook and loops (16) opposite halves. To release the finger hood (15) the wearer using their opposite hand (23) brushes or lifts the finger hood (15) forwards which releases the hook and loop material (16) allowing the finger hood (15) to return to an upright position or, the wearer releases the finger hood section (15) by brushing the finger hood in the opposite direction against an object which releases the hook and loop material (16) allowing the finger hood section (15) to return to an upright position. The elastic band (17) is sewn to both sides of the mitten backing (12) across the finger sections (14) to restrict the mitten backing (12) and the glove portion (11) from ballooning outwards when the hand (23) is closing or when the finger sections (14) are flexing.

As can be seen in FIG. 3 a fight handed mitten-glove (10) with the palm down. The mitten backing (12) is shown with the finger hood section (15) folded back and anchored by the hook and loop material (16). At different times the wearer may want to view the finger section (14) ends (24) for precision placement and manipulation. The finger hood section (15) is anchored back onto itself by the wearer using the opposite hand (23) or a stationary object to brush the finger hood section (15) back until the hook and loop material (16) engages. To return the finger hood (15) to an upright position, the wearer would use their opposite hand or a stationary object to brash or lift upwards on the finger hood section (15) releasing the hook and loop (16) material. The mitten backing (12) would then be ready to accept the wearers fingers (14') in the finger hood section (15). The elastic band (17) which extends the width of the mitten backing (12) keeps the glove portion (11) finger sections (14) in contact with the wearers fingers (14') by restraining both the glove portion (11 ) and the mitten portion (12) from ballooning outwards when the hand (23) is closing.

Figure 4:
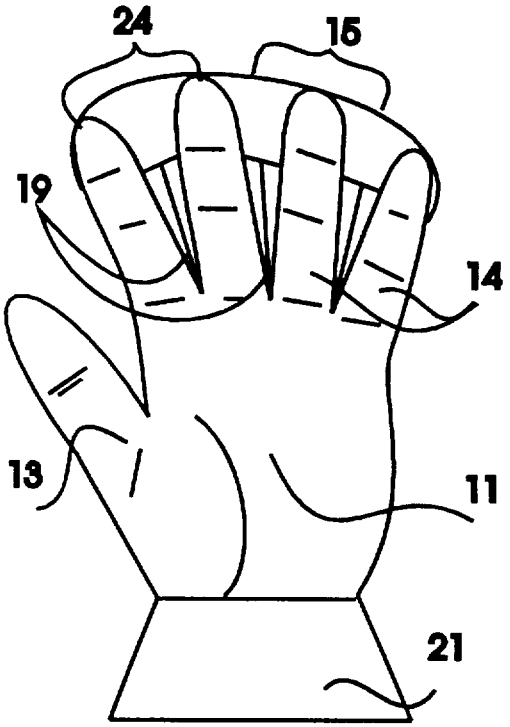
FIG. 4 is a left handed mitten-glove, palm up, with the finger sections spread laterally, which shows the pleated web between the finger sections and the extended finger hood behind the finger sections.

As can be seen in FIG. 4 a left handed glove portion (11 ) palm up, with the finger sections (14) extended laterally, exposing the expanded pleated web portions (19) and the expanded finger hood section (15). The pleated web portion (19) is sewn to the base of the inside finger sections (14), and along the inside finger sections (14) longitudinal length to the straight edge (18") of the finger end cover (18). The pleated webs (19) serve several functions. One of the functions of the pleated web (19) is to seal out the external environment, and hold in the mitten-gloves (10) internal conditions by sealing the open space between the finger sections (14). Another function of a pleated web (19) is to provide moveable finger sections (14). When the finger sections (14) are extended laterally the pleated web (19) unfolds from between the finger sections (14). The pleated web (19) allows for the perpendicular movement of individual finger sections (14), by a pleated web (19) between each finger section (14) extending with a finger section (14) in conjunction with the finger end covers (18). When the finger sections (14) are together the material between the fingers (pleated webs 19), makeup the side panels of the finger sections ( 14).

Figure 5:
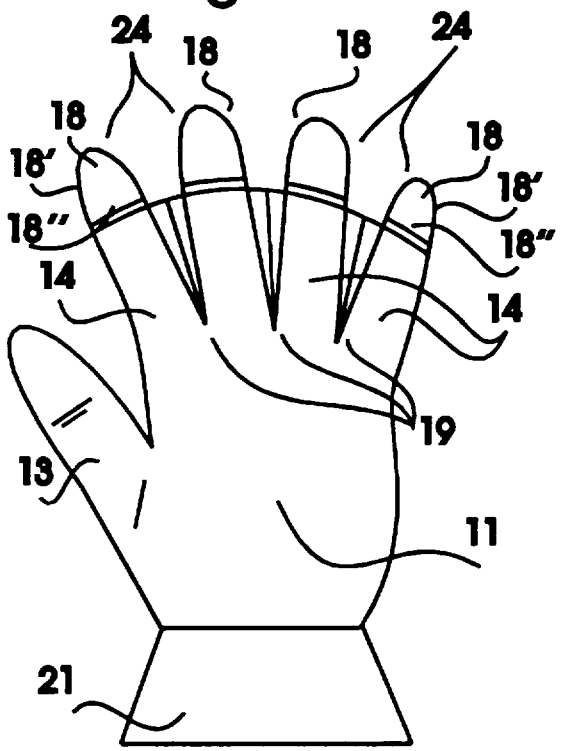
FIG. 5 is a fight handed mitten-glove, palm down, inside view with the finger sections spread laterally, showing the pleated web portions attached between the finger sections, and the finger end covers attached to the end of the finger sections, which makes up the mitten backing attachment line.

As can be seen in FIG. 5 a fight handed glove portion (11) palm down, inside view with pleated webs (19), and finger end covers (18) attached. A pleated web (19) is sewn between the finger sections (14) to a distance along the longitudinal length of the finger sections (14). A finger end cover (18) is sewn around the curved periphery of the finger section (14) end (24). The corner of the straight edge (18") of the finger end cover (18) and the corner of the top end (19") of the pleated web (19) intersect to form a mitten backing (12) attachment line. The mitten backing (12) is sewn across the straight edge (18") of the finger end covers (18) and across the top (19") edge (22) of the pleated webs (19).

Figure 6:
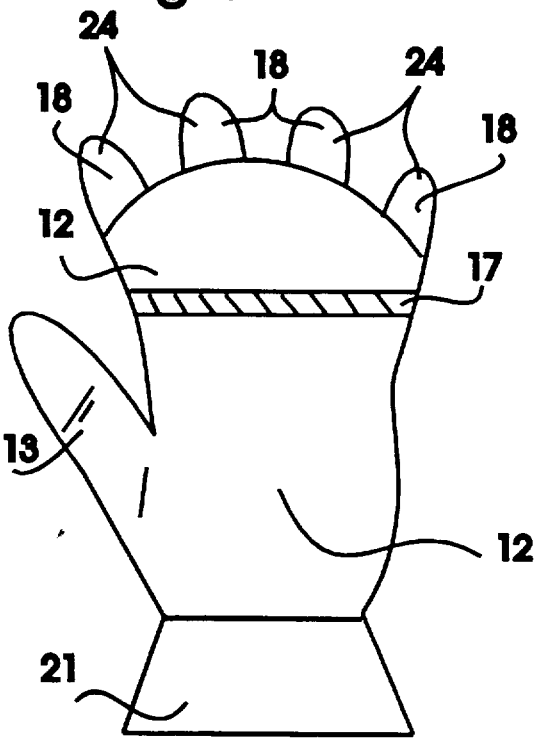
FIG. 6 is a modified fight handed mitten-glove, palm down, fingers laterally extended, with finger end covers attached to the end of the finger sections, also the mitten backing is shown without a finger hood.

FIG. 6 shows a modified fight handed mitten-glove (10) without a finger hood section (15). The modified mitten-glove (FIG. 6) is identical to the applicants present invention (10) except for not having a finger hood (15). A pleated webs (19) top edge (22) and a finger end covers (18) straight edge (18") intersect to form a mitten backing (12) attachment line. A mitten backing (12) is sewn across the expanded straight edge (18") of a finger end cover (18) and across a pleated webs (19) top edge (22). Instead of the mitten backing (12) extending upwards to cover the finger end covers (18) as does a finger hood (15), the modified mitten backing (FIG. 6) extends downwards and is sewn around the glove portions (11 ) periphery to the cuff (21 ). The open mitten backing (12) allows more heat to contact each finger (14'). When the finger sections (14) are spread laterally the pleated web portion (15) extends out away from the fingers (14') exposing more of the finger (14') area to the inside ambient conditions of the mitten-glove (10). The elastic band (17) prevents the glove portion (11) and the mitten portion (12) from ballooning outwards.

Figure 7:
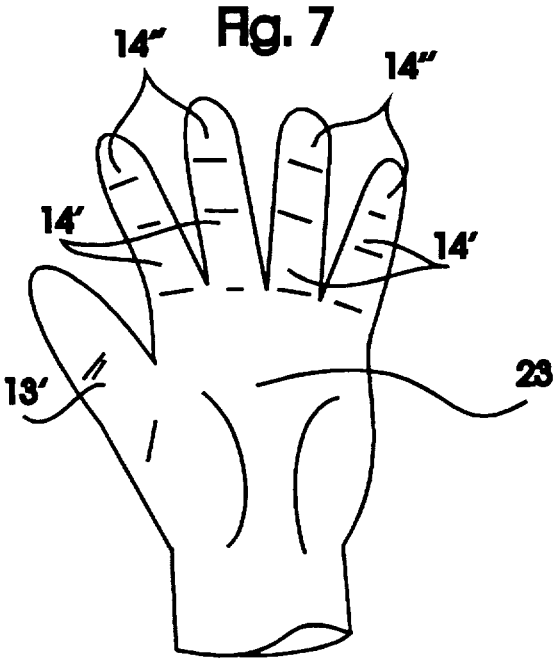
FIG. 7 is a left hand, palm up, showing the laterally spread fingers, the thumb, palm, and finger ends.

As can be seen in FIG. 7 a hand (23) that comprises four fingers (14'), four finger ends (14") a thumb (13') and a palm. When the hand (23) is in the glove portion (11) the finger ends (14") are placed in the pocket formed between the finger sections (14) end (24) and the finger end covers (18). To move the fingers (14')to the mittens finger hood (15) section, the wearer retracts their fingers (14') downwards below the finger end covers (FIG. 8 No. 18) straight edge (FIG. 5 No. 18") then extends them upwards and forwards into the mitten backing (FIG. 2 No. 12) finger hood section (FIG. 2 No. 15).

As shown in FIG. 8A and 8B the finger end cover (18) is made from the same material as the glove portion (11) or a suitable alternative such as cotton, nylon and the like. The curved edge (18') of the finger end covers (18) is sewn around the curved periphery of the finger section (14) end (24) on the backside, with the straight edge (FIG. 8B. No. 18") of the finger end covers (18) unattached, which forms a pocket for the finger end (14"). The finger end covers (18) provide protection from the exterior elements, as well as allowing the finger section (14) end (24) to be independent of the mitten backing (12). The straight edge (18") is a part of the mitten backing (12) attachment line. The independent finger section (14) ends (24) can be extended perpendicularly, which allows for the individual or collective use of each finger section (14) as in picking up a pencil or pulling the trigger on a gun or power tool, or grasping an object (not shown).

As shown in FIG. 9A and 9B a pleated web (19) comprises a triangular shaped leather part or other suitable material. The triangular shaped material (19) is folded in half longitudinally and sewn along the fold (20) forming a sewn pleat (20). The semi-ridged sewn pleat (20) assists in keeping a pleated web (19) from inverting when the finger sections (14) are spread laterally and/or flexed. The pleated web (19) in a folded position forms a glove (11) finger section (14) sides, wherein, the semi ridged pleated web (19) provides a typical glove feel and workability to a glove portion (11). The base of the fingers (14') pivot laterally a small degree, the finger ends (14") pivot laterally a proportionally longer distance. In an unfolded or open position (FIG. 9A) a pleated web (19) provides enough extension to provide for the lateral and perpendicular movement of the finger sections (14). The narrow bottom (19') section is attached between a finger section (14) at the base, and the wider section (19") is attached towards a finger section (14) end (24). The edges (22') are sewn longitudinally along the finger sections (14). The top (19") edge (22) and the finger end covers (18) edge (18") intersect to form a mitten backing (12) attachment line. The mitten backing (12) is sewn across a straight edge (18") of a finger end cover (18) and across the pleated webs (19) top edge (22).

Having thereby described the subject matter of this invention, it should be apparent that many substitutions, modifications, and variations of the invention are possible in light of the above teachings. It is therefore to be understood that the invention as taught and described herein is only to be limited to the extent of the breath and scope of the claims.

I claim:

1. A mitten-glove combination hand covering comprising:

a glove portion fitted for the hand having separate finger sections for each finger and thumb and a cuff;

finger end covers attached to the end of said finger sections along a longitudinal edge defined by the distal end of the finger section and the proximal end of the finger end covers;

pleated, triangular-shaped web portions attached between the finger sections up to said longitudinal edge;

a mitten portion attached to the periphery of the glove portion, to the cuff, along said longitudinal edge and along said pleated, triangular-shaped web portions thereby forming the back of said hand covering;

and an elastic band located on the mitten portion which extends longitudinally from one side of the hand covering to the other thereby preventing the mitten portion from ballooning out when the fingers of the user's hand are in the glove portion.

2. The mitten-glove combination hand covering of claim 1, wherein said web portions are folded in half longitudinally and sewn along said fold thereby forming a sewn pleat.

3. The mitten-glove combination hand covering of claim 1, wherein the narrow portion of said pleated, triangular-shaped web portions are attached between the fingers and the wide portion of said pleated, triangular-shaped web portions are attached to the finger sections ends where the finger end covers meet the finger sections.

4. The mitten-glove combination hand covering of claim 1, wherein the mitten portion forms a finger hood which extends past the finger end covers and forms a receiving pocket for the finger tips of the wearer's hand.

5. The mitten-glove combination hand covering of claim 4, wherein a portion of hook and loop fastener is attached to the upper section of said finger hood and a mating portion of hook and loop fastener is attached to the lower section of said finger hood such that said finger hood can be secured back upon itself by connecting the mating hook and loop fastener portions.

6. A method of using the mitten-glove combination hand covering of claim 5 which comprises inserting a hand into said cuff, placing the fingers into the individual finger sections, brushing said finger hood upward with the opposite hand or a stationary object in order to disengage the hook and loop fasteners, removing the fingers from the individual finger sections when said fingers become cold, inserting the fingers into said finger hood of said mitten portion to warm the fingers, removing the fingers from the finger hood of the mitten portion once the fingers have become warm, inserting the fingers into the individual finger sections and brushing the finger hood downward with the opposite hand or a stationary object in order to engage the hook and loop fasteners.

* * * * *